United States Patent [19]

Kremer

[11] Patent Number: 4,746,156

[45] Date of Patent: May 24, 1988

[54] GOLF BALL RETRIEVER

[76] Inventor: Donald R. Kremer, 3795 Sherman, North Bend, Oreg. 97459

[21] Appl. No.: 52,476

[22] Filed: May 21, 1987

[51] Int. Cl.[4] ..... A63B 57/00

[52] U.S. Cl. ..... 294/19.2; 273/32 F; 273/162 E

[58] Field of Search ..... 294/19.2, 19.1, 99.1, 294/110.1, 110.2; 273/32 F, 162 E

[56] References Cited

U.S. PATENT DOCUMENTS 2,834,629 5/1958 Williams ..... 294/19.2

4,013,295 3/1977 Baughmann ..... 294/19.2

*Primary Examiner*—James B. Marbert

*Attorney, Agent, or Firm*—James D. Givnan, Jr.

[57] ABSTRACT

A ball retriever includes a pair of ball engaging members pivotally mounted on a base affixed to an elongate handle. The ball engaging members are driven closed about a ball being retrieved by a cam carried by a locking pin axially displaced upon contact with the ball. The upper ends of the ball engaging members are urged into a cam groove by leaf springs to prevent opening movement of the ball engagement members. Ball release is effected by manual displacement of the cam from intermediate the upper end of the ball engaging member.

7 Claims, 1 Drawing Sheet

GOLF BALL RETRIEVER

BACKGROUND OF THE INVENTION

The present invention concerns devices for retrieving spherical articles such as golf balls.

In the prior art are several devices for retrieving golf balls from inaccessible areas such as golf course water hazards. A number of the prior devices disclose cooperating loops or arm members, which close against the golf ball subsequent to ball tripping an overcenter locking arrangement. Examples of such devices are found in U.S. Pat. Nos. 1,452,679; 1,696,817; 2,549,257; 2,834,629; 3,669,427; and 3,922,027.

A drawback to the known prior art devices are their complexity and resulting cost of manufacture as well as being of doubtful reliability when retrieving a ball from a body of water having a muddy bottom or a fast current. Another drawback to earlier devices is that as ball engagement is normally several feet from the user causing a problem if the device requires precise locating over the ball. Toward overcoming this problem, a highly visible sighting disk is utilized in the retrieval device disclosed in U.S. Pat. No. 3,669,427. As retrieval devices are stowed within a golf bag, it is desirable that such devices be of a compact nature and not susceptible to damage upon contact with golf clubs.

U.S. Pat. No. 4,046,412 discloses a golf ball retriever utilizing a pair of loop shaped members between which the ball is confined by a swingably mounted barrier which gravitates to prevent downward passage of a ball through a loop member during retrieval. Such a device requires that the user scoop the ball into one or the other of the loop shaped members.

SUMMARY OF THE PRESENT INVENTION

The present invention is embodied within a ball retriever of compact design and positive operation.

A base of the device slidably carries a locking pin which when actuated by ball contact drives a pair of loop shaped members into ball engagement. Leaf springs bias said members into engagement with a pin mounted cam to assure ball retention until manual displacement of the cam by the user permits the leaf springs to open the loop shaped members. The present retriever is of few parts with a low cost of manufacture and high reliability of operation.

Important objectives of the present retriever include the provision of a retrieving device having a pair of loop shaped ball engaging members which are closed about the ball being retrieved by a cam member acting on the remote ends of the arm members; the provision of a retrieving device wherein an arm locking cam is released by fingertip pressure with the arm members held open by spring components; the provision of a durable ball retrieving device of a lightweight and compact nature for convenient stowage within a golf bag.

BRIEF DESCRIPTION OF THE PREFERRED EMBODIMENTS

Figure 1:
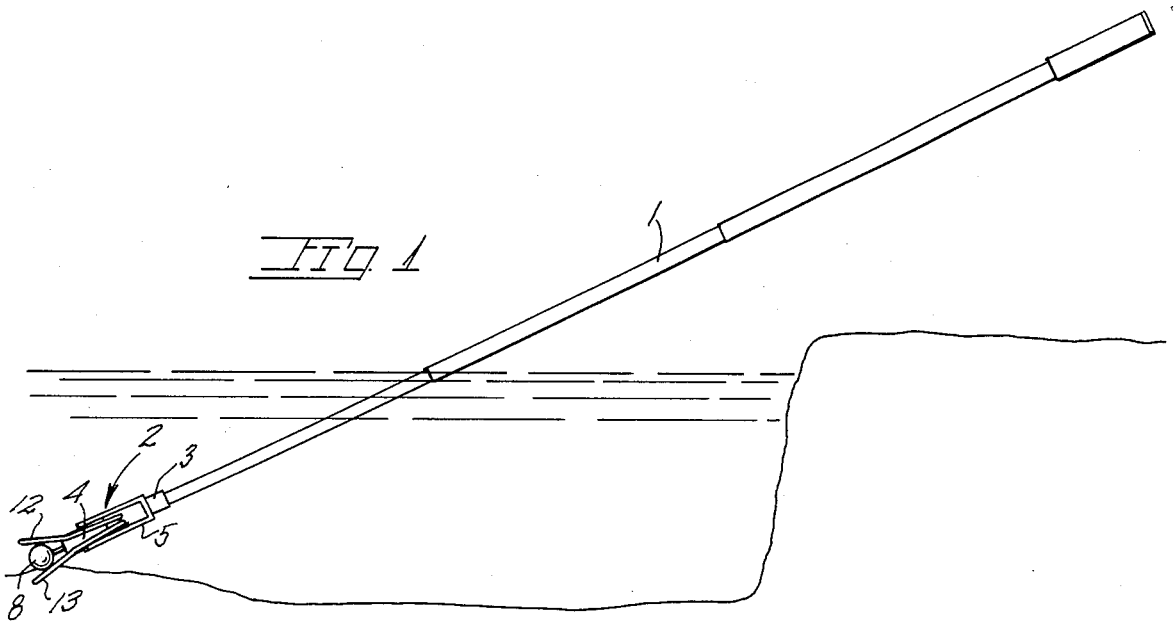
FIG. 1 is an elevational view of the present ball retriever shown in use.
Figure 2:
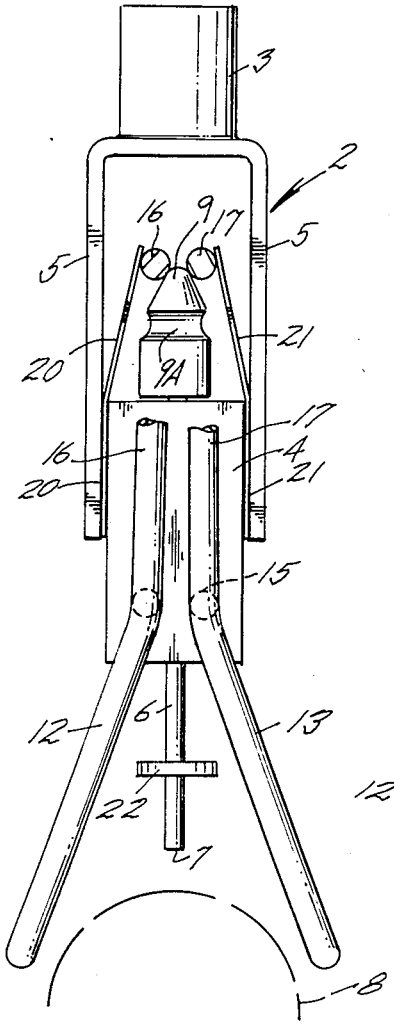
FIG. 2 is an elevational view of the device with the handle removed.
Figure 3:
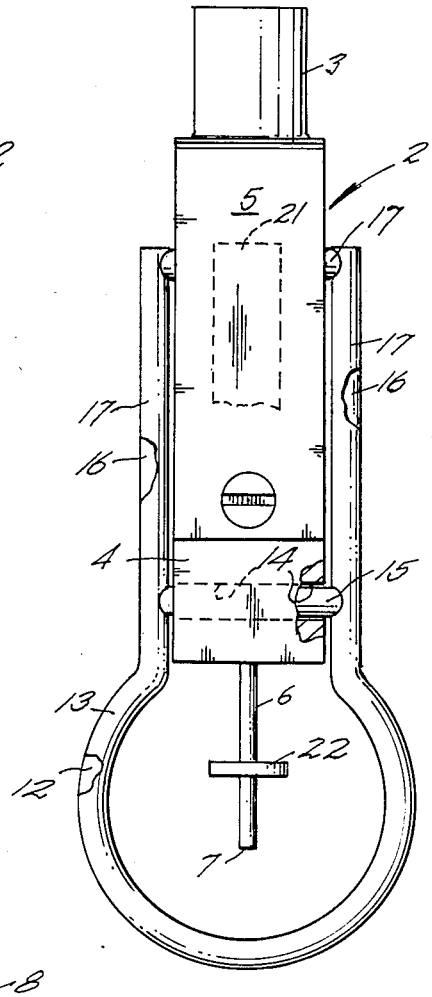
FIG. 3 is an elevational view taken from the right side of FIG. 1.
Figure 4:
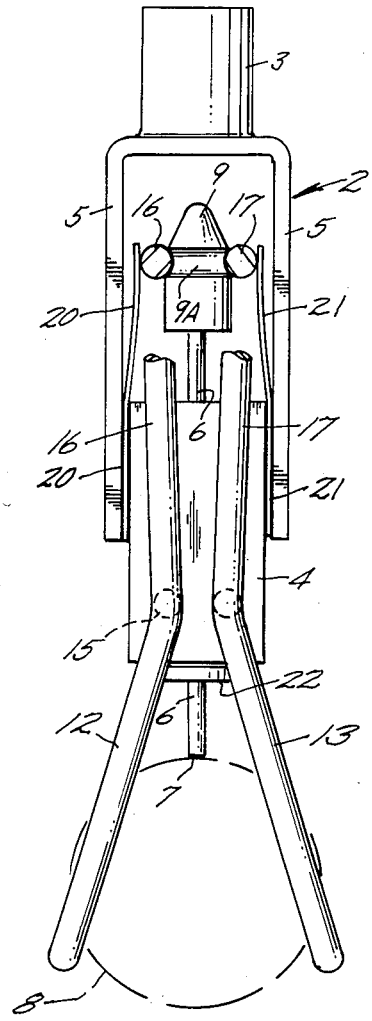
FIG. 4 is a view similar to FIG. 2 but showing the retriever closed about a golf ball being retrieved.

With continuing attention to the drawings wherein applied reference numerals indicate parts hereinafter similarly identified, the reference numeral 1 indicates a handle of the present retriever which preferably is of the telescopic type for obvious reasons.

Indicated generally at 2 is a base of the retriever having a socket 3 at one end for suitable attachment to an end of handle 1. The base includes a block 4 integral with a pair of legs 5 on which socket 3 is mounted.

Block 4 defines a central bore within which is slidably carried a trigger shown as a pin 6, termed a locking pin, having a first end at 7 engageable with a golf ball at 8 or other spherical article being retrieved. A cam 9 is on the remaining end of the pin and is of tapered configuration and includes a groove 9A.

Ball engaging members at 12 and 13 include lower portions of loop configuration adapted for closing engagement with the item being retrieved. Block 4 defines a pair of transverse bores as at 14 each of which receives a shaft 15 to constitute pivot means for each ball engaging member. The upper, or remaining ends of the ball engaging members constitute arm means 16 and 17 each of inverted U-shape and which are jointly acted on by interposed cam 9 to spread the arm member to thereby pivot the loop shaped members closed into ball engagement.

Biasing means at 20 and 21 are shown as a pair of leaf springs each attached at one of their ends to base 2 of the device and having their distal ends resting in engagement with an arm member to bias the arm members toward one another and into cam groove 9A resulting in the ball engaging members being held open for ball reception.

In use, the retriever is advanced so as to engage the end 7 of the locking pin into contact with the ball or other item being retrieved. Such contact may be very light as pin 6 separates the arm means against the action of the leaf springs. Pin movement terminates upon a pin flange 22 coming into abutment with block 4. Accordingly, ball engaging members 12 and 13 are now locked in place with the ball therebetween until such time as the user depresses cam 9 out of engagement with the arm means. As above noted, tripping of the present device is accomplished with only light contact of pin 6 with the ball which prevents inadvertent dislodgement of the ball from its resting place on the creek or pond bottom. The leaf springs 20 and 21 are protected from damaging contact from golf clubs by reason of being located intermediate legs 5. The ball engaging members 12 and 13 being of loop configuration, may if desired, be used in the manner of a scoop depending upon the terrain adjacent the ball.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

I claim:

1. A golf ball retriever comprising in combination, a handle, a base attached to said handle, a pair of ball engaging members each of said members terminating downwardly in a ball engaging portion for ball retention and each member terminating upwardly in arm means, pivot means swingably mounting said members intermediate their ends on said base, a locking pin slidably carried by said base and having a golf ball engageable first end, a limit stop on said locking pin, a cam at the remaining end of said pin and positionable by the pin intermediate said arm means of said ball engaging members to cause said ball engaging portion of each of said members to pivot toward one another into ball engagement upon contact of said first end of the pin with a golf ball, said cam having a taper, biasing means acting on said arm means and urging same toward one another and into cam engagement, and said cam manually positionable to permit said biasing means to move said ball engaging members apart for ball discharge.

2. The ball retriever claimed in claim 1 wherein said cam defines a groove, said biasing means operable to retain said arm means in said groove to hold the ball engaging members in a ball retaining position.

3. The ball retriever claimed in claim 2 wherein said biasing means are a pair of leaf springs each having a distal end acting on said arm means.

4. The ball retriever claimed in claim 1 wherein said cam is of conical shape.

5. A golf ball retriever comprising in combination, a handle, a base attached to said handle, ball engaging members swingably mounted on said base and having cooperating ball engaging members and each terminating at their remaining end in an arm, trigger means carried by said base and adapted to close the ball engaging members toward one another to capture a golf ball therebetween, said trigger means including a pin, a cam on one end of said pin engageable with the arm of each ball engaging member to swing same to a closed position, and springs one each acting on said ball engaging members to hold same in cam engagement.

6. The retriever claimed in claim 5 wherein said cam defines a groove to receive each arm.

7. The retriever claimed in claim 6 wherein said cam is of conical shape.

* * * * *